US006905592B2

(12) United States Patent
Bence et al.

(10) Patent No.: US 6,905,592 B2
(45) Date of Patent: Jun. 14, 2005

(54) PROCESS FOR THE DESULPHURIZATION OF FEED STREAMS

(76) Inventors: Roger Bence, 65 Pursewardens Close, Ealing, London (GB), W139PW; Stephen Caig Littlewood, 3 Deep Acres, Chesham Bois, Amersham, Buckinghamshire (GB), HP6 5NX; Philip Henry Donald Eastland, 26 Elleray Rd., Teddington, Middlesex (GB), TW11 0HG ( * ) Notice: Subject to any disclaimer, the term of this patent is extended or adjusted under 35 U.S.C. 154(b) by 115 days.

(21) Appl. No.: 10/158,703

(22) Filed: May 30, 2002

(65) Prior Publication Data

US 2003/0007902 A1 Jan. 9, 2003

(30) Foreign Application Priority Data

Jun. 1, 2001 (GB) ..... 0113370

(51) Int. Cl.[7] ..... C01B 17/00; C10G 19/16

(52) U.S. Cl. ..... 208/208 R; 423/244.01; 423/244.06; 423/230; 423/231; 208/208 R; 208/209; 208/244; 208/245; 208/247; 208/248; 208/249

(58) Field of Search ..... 423/244.01, 244.06, 423/230, 231, 208 R, 209, 244, 245, 247, 248, 249

(56) References Cited

U.S. PATENT DOCUMENTS

| | | | | |
|---|---|---|---|---|
| 4,978,439 A | | 12/1990 | Carnell et al. | 208/91 |
| 5,507,939 A | | 4/1996 | Russ et al. | 208/65 |
| 5,720,901 A | | 2/1998 | De Jong et al. | 252/373 |
| 5,891,323 A | | 4/1999 | Willis | 208/211 |
| 6,103,206 A | | 8/2000 | O'Connor et al. | 423/210 |
| 6,149,886 A | * | 11/2000 | Schoubye | 423/242.1 |

FOREIGN PATENT DOCUMENTS

| | | |
|---|---|---|
| GB | 0320979 | 12/1988 |
| GB | 0527000 | 7/1992 |

* cited by examiner

*Primary Examiner*—Wayne A. Langel
(74) *Attorney, Agent, or Firm*—Davidson, Davidson & Kappel, LLC

(57) ABSTRACT

The invention relates to: a process for the desulphurization of feed streams comprising: supplying a hot process stream to a lead catalyst bed (8) comprising a first sulphur-removing catalyst and a second sulphur-removing catalyst under conditions whereby sulphur is removed from the process stream by the first sulphur-removing catalyst and said second sulphur-removing catalyst does not effectively remove sulphur from the stream at the operating temperature of the lead catalyst bed for the duration of the bed's life; collecting a hot partially sulphur-depleted stream from the lead catalyst bed and cooling said stream; passing said cooled stream through a lag catalyst bed (11) comprising the first sulphur-removing catalyst and the second sulphur-removing catalyst under conditions whereby sulphur is removed from the process stream by the second sulphur-removing catalyst and said first sulphur-removing catalyst removes sulphur less efficiently from the stream at the operating temperature of the lag catalyst bed; and recovering said sulphur-depleted stream from the second catalyst bed. In addition it relates to, apparatus for the desulphurization of feed streams which comprises: a lead catalyst bed (8) comprising a first sulphur-removing catalyst and a second sulphur-removing catalyst capable of operating under conditions whereby sulphur is removed from the process stream by the first sulphur-removing catalyst and said second sulphur-removing catalyst does not effectively remove sulphur from the stream at the operating temperature of the lead catalyst bed (8) throughout the lead bed's operating life; means (9) for collecting a hot partially sulphur-depleted stream from the lead catalyst bed (8) and cooling said stream; a lag catalyst bed (11) comprising the first sulphur-removing catalyst and the second sulphur-removing catalyst capable of operating under conditions whereby sulphur is removed from the process stream by the second sulphur-removing catalyst and said first sulphur-removing catalyst does not efficiently remove sulphur from the stream at the operating temperature of the lag catalyst bed(11).

9 Claims, 1 Drawing Sheet

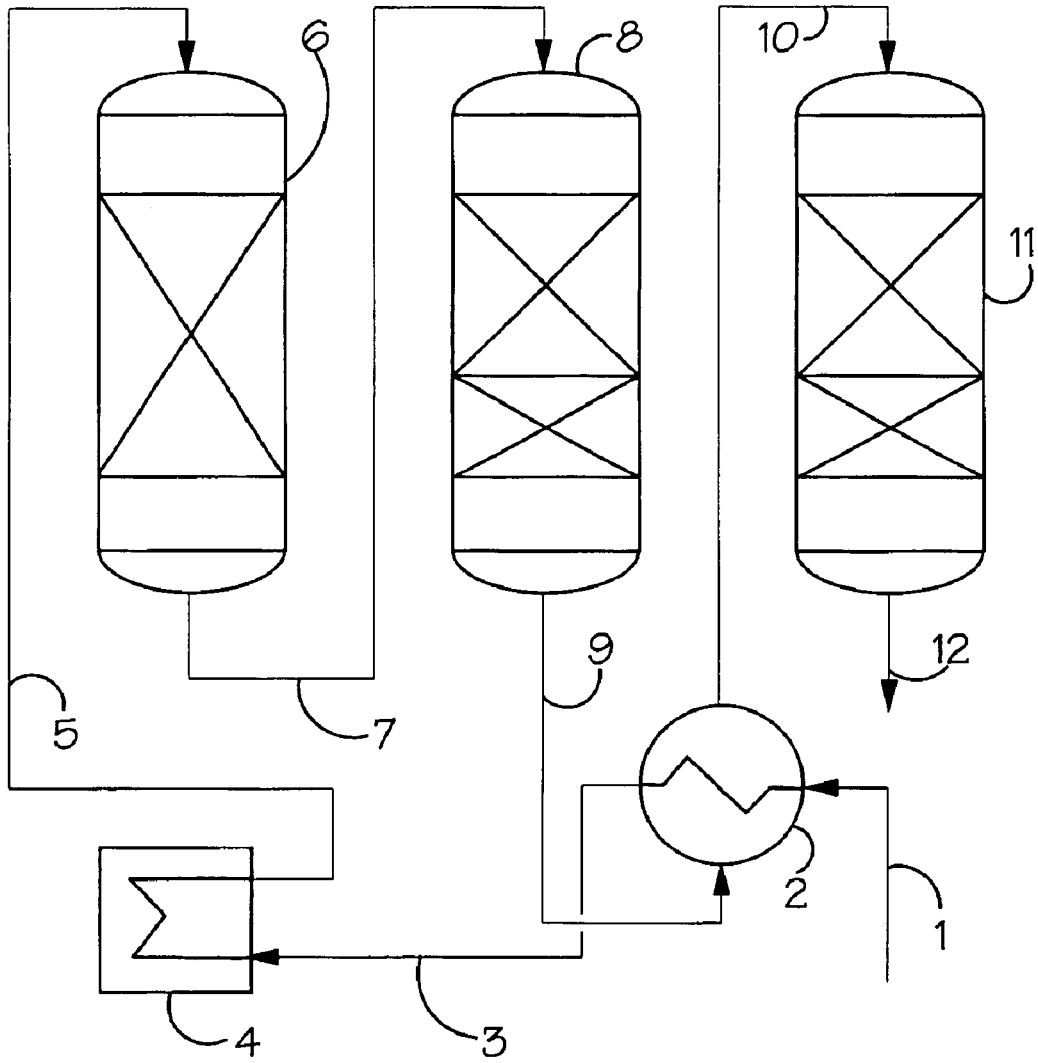
6
8
10
11
9
12
5
7
2
1
4
3

PROCESS FOR THE DESULPHURIZATION OF FEED STREAMS

BACKGROUND OF THE INVENTION

The present invention relates to a desulphurisation process. More particularly, the present invention relates to the removal of sulphur compounds such as hydrogen sulphide from process streams. Most particularly, the present invention relates to the removal of sulphur compounds from hydrocarbon streams.

Hydrocarbon process streams often comprise a significant quantity of sulphur compounds. For example, a gaseous hydrocarbon feed may comprise in excess of 50 ppm by volume expressed as equivalents of hydrogen sulphide.

It is generally desirable to remove these sulphur compounds from the feed or at least to reduce them to a low level, for example to a level in an amount of about less than 5 ppm by volume. Indeed, more recently, there has been a demand for the sulphur content to be reduced to much lower levels, for example of the order of 1 ppm by volume or less.

One method of sulphur removal that has been used is to contact the feed with a bed of an absorbent catalyst such as zinc oxide which will remove some of the sulphur. Zinc oxide generally has a low capacity for sulphur at reduced temperatures and therefore the contact between the feed and the zinc oxide is generally conducted at elevated temperature for example at from about 260° C. to about 450° C.

Further the quantity of sulphur that escapes the zinc oxide bed is related to the quantity of sulphur that has already been absorbed into the zinc oxide bed. Thus a bed with 10% sulphur absorbed onto it might produce an exit gas with 1 ppm sulphur in it, but when the absorbed sulphur has increased to 20%, the exit gas might contain 10 ppm sulphur.

The bed of zinc oxide will generally require regular replenishment and it is therefore general practice to operate the desulphurization process with two beds located in series in positions (A) and (B). When replenishment is required, fresh zinc oxide is generally loaded in the bed in position (A) which is then switched such that it is in position (B). This means that the bed with the oldest catalyst is contacted with the feed first. The bed which was originally in position (B) is moved to position (A) where it will continue to operate until analysis of the exit stream from bed B suggests that replenishment is required again. The movement of the beds between positions (A) and (B) is usually carried out by switching flow in connecting pipework using valves.

SUMMARY OF THE INVENTION

Whilst removal of the sulphur by this method has proved successful it suffers from the disadvantage that the level of desulphurisation achieved is not sufficiently low for modern requirements.

Recently, so-called ultra purification catalysts have been identified. These enable higher amounts of sulphur to be removed than has been achievable heretofore such that feeds with the lower sulphur contents required can be achieved. However, these catalysts suffer from the disadvantage that they are often expensive, and achieve a low sulphur loading.

A further drawback is that they are readily denatured at increased temperatures and therefore are not suitable for the treatment of hot feeds at the temperature at which zinc oxide is most effective.

It is therefore desirable to provide a process which enables the low levels of sulphur required in feeds to be achieved continuously, i.e. without interruption for absorbent replacement, and whilst minimising the costs incurred, by maximising the efficient use of the catalysts, and reducing the number of process vessels required.

Thus according to a first aspect of the present invention there is provided a process for the desulphurisation of process streams comprising:

supplying a hot process stream to a lead catalyst bed comprising a first sulphur-removing catalyst and a second sulphur-removing catalyst under conditions whereby sulphur is removed from the process stream by the first sulphur-removing catalyst and said second sulphur-removing catalyst may not effectively remove sulphur from the stream at the operating temperature of the lead catalyst bed;

collecting a hot partially sulphur-depleted stream from the lead catalyst bed and cooling said stream;

passing said cooled stream through a lag catalyst bed comprising the first sulphur-removing catalyst and the second sulphur-removing catalyst under conditions whereby sulphur is removed from the process stream by the second sulphur-removing catalyst and said first sulphur-removing catalyst operates less efficiently to remove sulphur from the stream at the operating temperature of the lag catalyst bed; and recovering said sulphur-depleted stream from the second catalyst bed.

The first sulphur-removing catalyst which will operate at the temperature of the hot feed may be any suitable catalyst but is preferably zinc oxide, titanium dioxide, manganese oxide or iron oxide compounds with zinc oxide being particularly preferred. This catalyst will remove a majority of the sulphur present and in a preferred arrangement may reduce the sulphur present to a level that has been acceptable heretofore, for example to less than 10 ppm.

The preferred catalyst, zinc oxide, may be present in any suitable form. In one arrangement, it may be present as a particulate zinc-oxide absorbent having a surface area of greater than 50 $m^2.g^{-1}$. The particulate absorbent catalyst will preferably comprise at least 60%, more preferably 80%, of zinc oxide by weight. The zinc oxide may be wholly or partially hydrated or in the form of a salt or a weak acid. A particularly suitable zinc oxide is sold by Dycat or Sudchemie.

The first sulphur-removing catalyst may be composited with a suitable binder such as clays, graphite, inorganic oxides including one or more of alumina, silica, zirconia, magnesia, chromia, or boria.

The second sulphur-removing catalyst is preferably an ultra-purification catalyst which is capable of reducing the sulphur levels to, in a preferred embodiment, amounts of the order of 1 to 10 ppb or less. These ultra-purification catalysts do not generally operate effectively in the hot temperatures where zinc oxide operates most effectively. Indeed, they may be sintered or otherwise denatured at these temperatures. Examples of ultra-purification catalysts include copper based catalysts such as Synetix Puraspec 2084.

The temperature of the hot process stream is generally in the range of from about 260° C. to about 450° C.

The stream leaving the lead catalyst bed will be cooled by any suitable means. In one arrangement, it may be cooled by heat-exchange against incoming process stream.

The cooled stream is then passed to the lag catalyst bed. The temperature of the cooled stream is preferably in the region of 170° C. to 250° C. As this lower temperature is below the optimum operating temperature of the first sulphur-removing catalyst, it will operate less efficiently in the removal of sulphur from the feed in the lag catalyst bed. However, in this lag catalyst bed, the second sulphur-removing catalyst will be operating at optimum conditions and will serve to further reduce the amount of sulphur present in the feed.

Thus, it will be understood that some, preferably the majority, of the sulphur is removed by the relatively cost effective first sulphur-removing catalyst, e.g. the zinc oxide. The second sulphur-removing catalyst will then serve to remove additional sulphur such that the sulphur content is reduced to the required level. By this means, the amount of the relatively expensive second sulphur-removing catalyst required is minimised which has substantial cost-saving implications.

When it is detected that the sulphur content of the stream leaving the lag catalyst bed is approaching too high a level, the flow of feed within the system can be altered such that the lag catalyst bed becomes located in the lead catalyst bed position and the previous lead catalyst bed after replenishment becomes located in the lag catalyst bed position.

The catalyst from the former lag catalyst bed (the new lead catalyst bed) will include only partially used first sulphur-removing catalyst since this was protected by the lead bed when the bed was in the lag position. The second sulphur-removing catalyst, which has been exhausted during the operation in the lag position substantially is not required to operate in the lead position. Although the increased temperature in the new lead position may cause sintering of the second sulphur-removing catalyst, this does not detrimentally effect the operation or efficiency of the system.

The former lead bed before being moved to the lag position can be replenished with fresh first and second sulphur-removing catalyst. The second sulphur-removing catalyst will then take the part of the further removal of sulphur step in the lag position and the fresh first sulphur-removing catalyst will be ready for the next change to the lead position.

Preferably, the replenishment will occur to the lead catalyst bed after it has been taken off stream, it will then be reintroduced as the lag catalyst stream. Whilst replenishment is occurring, the stream will be fed through the lag bed such that the removal of sulphur from the stream to the required specification can continue. When the replenished bed is reintroduced as the new lag bed, the former lag bed, which was operating as the sole bed during the replenishment, will become the lead bed.

The switching from lead to lag position may be carried out by any suitable means but is preferably carried out by switching valves.

The first and second sulphur-removing catalysts may be provided in the lead and lag beds in any appropriate manner. In one arrangement they may be admixed. However, they may be in layers. The layers may be in contact or may be separate. Furthermore, the relative quantities of each absorbent may be easily varied in the light of the plant operating experience to provide the most effective operation for the sulphur content of the feed gas experienced.

The first and second sulphur-removing catalysts in the lead and lag beds may be located in separate vessels or they may be located in the same vessel with appropriate cooling means being located between the beds.

The present invention also relates in a second embodiment to apparatus for desulphurisation of process streams comprising:

a lead catalyst bed comprising a first sulphur-removing catalyst and a second sulphur-removing catalyst capable of operating under conditions whereby sulphur is removed from the process stream by the first sulphur-removing catalyst and said second sulphur-removing catalyst substantially does not remove sulphur from the stream at the operating temperature of the lead catalyst bed;

means for collecting a hot partially sulphur-depleted stream from the lead catalyst bed and cooling said stream;

a lag catalyst bed comprising the first sulphur-removing catalyst and the second sulphur-removing catalyst capable of operating under conditions whereby sulphur is removed from the process stream by the second sulphur-removing catalyst and said first sulphur-removing catalyst removes sulphur from the stream less effectively at the operating temperature of the lag catalyst bed.

The process and apparatus of the present invention may be used in combination with an optional hydrodesulphurisation reaction, the reactor for which will be located before the lead bed of the present invention. The hydrodesulphurisation may be carried out by any suitable means and in suitable reactor.

The process and apparatus of the present invention is suitable for desulphurisation of both liquid and gas process streams, preferably feeds. It is particularly suitable for the desulphurisation of natural gas, refinery gases or vaporised naptha.

BRIEF DESCRIPTION OF THE DRAWINGS

The present invention will now be described, by way of example, a preferred embodiment of the present invention with reference to the accompanying drawing in which:

FIG. 1 is a schematic representation of one arrangement of apparatus in accordance with the present invention.

DETAILED DESCRIPTION OF THE INVENTION

As illustrated in FIG. 1, a feedstock, such as a natural gas feedstock, is fed via line 1 to a gas/gas interchanger 2 where it is used to cool the hot partially sulphur depleted stream exiting the lead catalyst bed as described below.

The feed is then passed in line 3 to a desulphurisation interchanger 4 where the stream is heated. The heated stream is then passed in line 5 to an optional desulphurisation reactor 6.

The hot stream is then passed in line 7 to the lead catalyst bed 8 which will comprise an upper layer of zinc oxide and a lower layer of an ultra-purification catalyst. The bed will be operated at a temperature in the range of from about 260° C. to about 420° C. The zinc oxide will remove sulphur from the stream to an appreciable amount, typically down to 10 ppb at the start of its operation, but may be rising to 10 ppm at the end of its operating life.

The thus depleted stream, is then passed in line 9 to the interchanger 2 where it is cooled against the incoming feed. The cooled stream, which is now typically at a temperature of from about 170° to about 250° C., is passed in line 10 to the lag catalyst bed 11 which will have the same catalyst layers as the lead catalyst bed.

At the operating temperatures, the zinc oxide will operate less efficiently in sulphur removal. However, the ultra-purification catalyst will operate effectively to remove sulphur such that the stream leaving in line 12 may have as little as less than 1 ppb sulphur.

When analysis indicates that the sulphur content in stream 12 is beginning to rise to unacceptable levels, the arrangement will be switched such that stream 7 will bypass the first catalyst bed 8 and be cooled in the interchanger 2 before being passed to catalyst bed 11. Bed 8 will then be replenished and brought back onstream in the position of bed 11, original bed 11 will then operate as original bed 8 such that hot feed from line 7 will pass through it.

Typical sulphur contents and catalyst states are indicated in Table 1 at the start and end of each operating period for the lead and lag bed.

TABLE 1

| | Lead Bed start of second life | Lead Bed end of life | Lag Bed start of life | Lag Bed end of life |
|---|---|---|---|---|
| Inlet gas S content | 10 ppm | 10 ppm | 10 ppb | approx 9 ppm |
| Inter bed S content | 10 ppb | 9 ppm | 10 ppb | 10 ppb |
| Exit gas S content | 10 ppb | 9 ppm | <<1 ppb | <1 ppb |
| ZnO bed: Absorbed S by weight of bed | approx 10% S | approx 18% S | 0% S | 10% S |
| Ultra-Pure bed state | used | used | fresh, 0% S | used |

What is claimed is:

1. A process for the desulphurization of feed streams comprising:

supplying a hot process stream to a lead catalyst bed, said lead catalyst bed comprising a first sulphur-removing catalyst and a second sulphur-removing catalyst, said lead catalyst bed being operated under conditions such that sulphur is removed from said hot process stream by said first sulphur-removing catalyst and said second sulphur-removing catalyst does not effectively remove sulphur from the stream at the operating temperature of the lead catalyst bed for the duration of said bed's life;

collecting a hot partially sulphur-depleted stream from the lead catalyst bed and cooling said stream;

passing said cooled stream through a lag catalyst bed, said lag catalyst bed comprising said first sulphur-removing catalyst and said second sulphur-removing catalyst and said lag catalyst bed being operated under conditions such that sulphur is removed from said process stream by said second sulphur-removing catalyst and said first sulphur-removing catalyst removes sulphur less efficiently from the stream at the operating temperature of said lag catalyst bed; and recovering said sulphur-depleted stream from said second catalyst bed.

2. A process according to claim 1 wherein the first sulphur-removing catalyst is zinc oxide.

3. A process according to claim 1 wherein the second sulphur-removing catalyst is an ultra-purification catalyst which is capable of reducing the sulphur levels to amounts of the order of 10 ppb or less.

4. A process according to claim 2 wherein the second sulphur-removing catalyst is an ultra-purification catalyst which is capable of reducing the sulphur levels to amounts of the order of 10 ppb or less.

5. A process according to claim 1 wherein the temperature of the hot process stream is in the range of from about 260° C. to about 420° C.

6. A process according to claim 1 wherein the stream leaving the lead catalyst bed is cooled by heat-exchange against incoming feed.

7. A process according to claim 1 wherein the temperature of the cooled stream is in the region of 170° C. to 250° C.

8. A process according to claim 1 wherein the process additionally comprises:

detecting the sulphur content of said stream leaving said lag catalyst bed; and altering the flow of feed such that the lag catalyst bed becomes located in the lead catalyst bed position.

9. A process according to claim 8 wherein the original lead catalyst bed is replenished with fresh catalyst before being reintroduced in the lag catalyst bed position.

* * * * *

UNITED STATES PATENT AND TRADEMARK OFFICE

CERTIFICATE OF CORRECTION

PATENT NO. : 6,905,592 B2
APPLICATION NO. : 10/158703
DATED : June 14, 2005
INVENTOR(S) : Bence et al.

It is certified that error appears in the above-identified patent and that said Letters Patent is hereby corrected as shown below:

On the title page, please insert the following paragraph:

-- Item [73] Assignee: Davy Process Technology Limited
20 Eastbourne Terrace
London W2 6LE, United Kingdom --

Signed and Sealed this

Tenth Day of October, 2006

JON W. DUDAS
*Director of the United States Patent and Trademark Office*